United States Patent [19]

Huber

[11] 3,965,636

[45] June 29, 1976

[54] PANELING FOR WALLS OR THE LIKE

[76] Inventor: Eugen Huber, Echbeck, Germany

[22] Filed: Feb. 3, 1975

[21] Appl. No.: 546,822

[30] Foreign Application Priority Data

Feb. 1, 1974 Switzerland ..... 1393/74

[52] U.S. Cl. ..... 52/496; 52/758 A; 52/753 G

[51] Int. Cl.[2] ..... E04B 5/52

[58] Field of Search ..... 52/492, 494, 495, 496, 52/497, 758 A, 539, 484, 753 G, 666, 753 T, 488, 664, 669, 721, 690; 403/231, 241, 383, 403, 382

[56] References Cited

UNITED STATES PATENTS 2,826,116 10/1958 Browne ..... 52/496

FOREIGN PATENTS OR APPLICATIONS 2,008,292 11/1971 Germany ..... 52/496

145,376 5/1931 Switzerland ..... 52/496

*Primary Examiner*—Ernest R. Purser

*Assistant Examiner*—Carl D. Friedman

*Attorney, Agent, or Firm*—Michael J. Striker

[57] ABSTRACT

A paneling for walls or ceilings wherein a skeleton frame consists of one or more longitudinally extending braces each having an exposed surface and two marginal tongues whose thickness decreases in a direction away from the central portion of the respective brace, and several pairs of elongated moldings. Each brace is disposed between at least two pairs of parallel moldings which are normal thereto and whose end portions are bifurcated to receive the respective tongues in such a way that one prong of each bifurcated portion bears against the exposed surface and the other prong of each bifurcated portion bears against that surface of the respective tongue which faces away from the exposed surface. Discrete panels are disposed between and are supported by pairs of moldings at the opposite sides of a brace. The panels have grooved marginal portions which receive ledges provided on the adjacent moldings. The plane of the exposed surfaces of the moldings is parallel to and spaced apart from the plane of the exposed surface of a brace.

13 Claims, 4 Drawing Figures

PANELING FOR WALLS OR THE LIKE

BACKGROUND OF THE INVENTION

The present invention relates to panelings in general, and more particularly to improvements in panelings of the type wherein discrete panels are supported by or engage with a skeleton frame which is assembled of longitudinally and transversely extending frame members. Such paneling may be utilized as a decorative and/or protective cover for ceilings and/or walls as well as for many similar purposes.

A drawback of presently known panelings (whose components normally consist of wood) is that their assembly at the locus of use takes up a substantial amount of time. Moreover, the assembly of conventional panelings normally involves at least some finishing treatment, for example, the elimination of gaps or cracks which develop as a result of twisting, warping and/or other deformation of components during storage and/or during shipment to the locale of use. As a rule, a paneling consists of a frame and of discrete panels which are supported by the frame. The component parts of the frame must be cut to requisite length at the locus of use, and the panels are trimmed upon completed assembly of the frame so that they can properly cover the areas between the component parts of the frame.

Certain presently known panelings include a frame wherein the exposed surfaces of longitudinally and transversely extending frame members are disposed in a common plane and are flush with the exposed surfaces of the panels. Such panelings exhibit the drawback that any, even minor, shrinkage and/or expansion of their component parts results in the formation of cracks or gaps which detract from the appearance and are likely to accumulate dust, other foreign matter and/or to conceal vermin.

It was already proposed to assemble the frame of a paneling in such a way that the exposed surfaces of longitudinal frame members and the exposed surfaces of transverse frame members (such frame members together usually form a cellular structure whose cells are filled by discrete panels) are disposed in different planes. The transverse frame members normally overlap portions of longitudinal frame members. This is considered desirable because eventual gaps between the frame members are less likely to be visible even if the longitudinal frame members undergo substantial shrinkage (reduction of width). However, the cracks are still likely to develop, especially in response to twisting of transverse frame members and, even though less exposed, such cracks can still collect foreign matter and/or serve as a refuge and nesting place for vermin.

SUMMARY OF THE INVENTION

An object of the invention is to provide a novel and improved paneling which is less likely to develop cracks or gaps than heretofore known panelings.

Another object of the invention is to provide a paneling having a frame whose component parts are assembled in a novel and improved way which reduces the likelihood of twisting and/or other deformation of such component parts.

A further object of the invention is to provide novel panels for use in the improved paneling and to provide certain component parts of the frame with novel and improved means for engaging with and for supporting the panels.

An additional object of the invention is to provide a paneling which is of eye-pleasing appearance, which can be assembled with little loss in time, and which consists of a minimal number of different parts.

A further object of the invention is to provide a paneling of the above outlined character whose appearance is not unduly affected by eventual deviations of the dimensions of its component parts from a predetermined norm and whose eye-pleasing appearance is not unduly affected by shrinkage, swelling or other deformations of its components.

The invention is embodied in a decorative and/or protective paneling for walls, ceilings or the like. The paneling comprises a preferably cellular skeleton frame including at least one elongated first frame member or brace having two longitudinally extending marginal portions and at least one longitudinally extending tongue which includes one of the marginal portions and tapers in a direction away from the other marginal portion, and at least two spaced-apart elongated second frame members or moldings having bifurcated end portions into which the tongue of the brace extends. Each of the end portions has a pair of prongs engaging the tongue at the opposite sides thereof (i.e., the tongue may be wedged into the bifurcated end portions to reduce the possibility or likelihood of the formation of gaps or cracks). The paneling further comprises at least one panel which is disposed between and is supported by the moldings.

The brace has a first exposed surface extending between its marginal portions and disposed in a first plane (such exposed surface can be seen by or faces the observer of the assembled paneling). The moldings have second exposed surfaces which are preferably coplanar with each other and are disposed in a second plane, i.e.; they are not coplanar with the exposed surface of the brace.

That surface of the tongue which faces away from the exposed surface of the brace is inclined with respect to such exposed surface. One prong of the bifurcated end portion of each molding engages the inclined surface of the tongue and the other prong of the bifurcated portion of each molding engages the exposed surface of the brace.

The novel features which are considered as characteristic of the invention are set forth in particular in the appended claims. The improved paneling itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
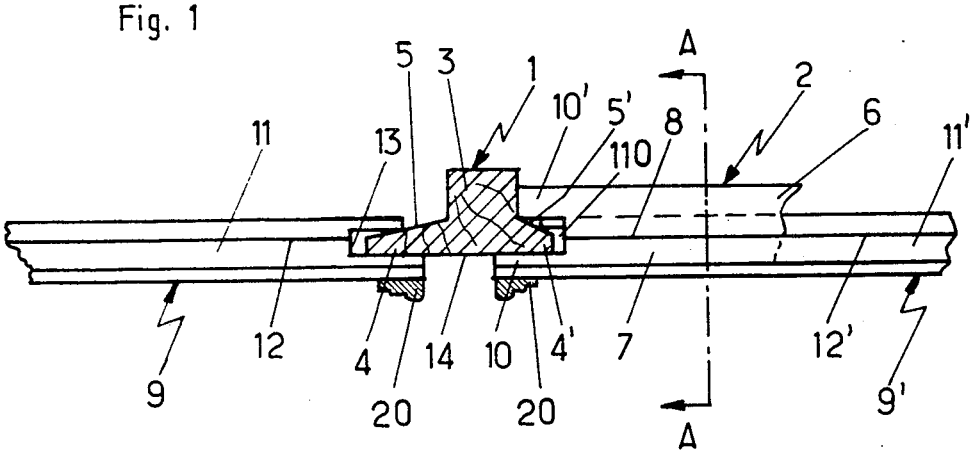
FIG. 1 is an end elevational view of a portion of a paneling which embodies the invention, with a first frame member shown in cross section.

The paneling which is shown in the drawing comprises a skeleton frame including one or more longitudinally extending profiled first frame members or braces 1 (only one shown) and several pairs of profiled second frame members or moldings 2. The moldings 2 support discrete panels 9 and 9'. The illustrated paneling is assumed to overlie the underside of a ceiling which is located above the paneling, as viewed in FIG. 1. The brace 1 can be secured directly to the ceiling or to the side walls of a room or the like at a requisite distance from the ceiling, depending upon whether the paneling is to be immediately or closely adjacent to or remote from the underside of the ceiling. Those end portions of the moldings 2 which are remote from the illustrated brace 1 can be secured to the aforementioned side walls or can engage additional braces, not shown.

The brace 1 and/or the molding 2 may but need not have a symmetrical cross-sectional outline (the outline of the brace shown in FIG. 1 is asymmetrical). The brace 1 has a preferably flat outer or exposed surface 14 (this is the surface a portion of which might be visible to a person standing below and looking at the underside of the assembled paneling, a relatively thick elongated central portion 3 which, when the frame including one or more braces 1 and two or more pairs of moldings 2 is assembled, extends above and beyond the molding 2, and two relatively thin elongated tongues 4, 4' each of which includes a marginal portion of the brace and which extend along the full length and are disposed at the opposite sides of the central portion 3. The undersides of the central portion 3 and tongues 4, 4' together constitute the exposed surface 14. Those surfaces (numbered 5 and 5') of the tongues 4, 4' which face away from the surface 14 are inclined with respect to the surface 14 so that the thickness of both tongues increases in a direction toward the central portion 3 and that each tongue exhibits a wedge-like cross-sectional shape, i.e., each tongue tapers in a direction away from the opposite marginal portion of the brace. The central portion 3 may but need not have a square of rectangular cross-sectional outline.

Figure 3:
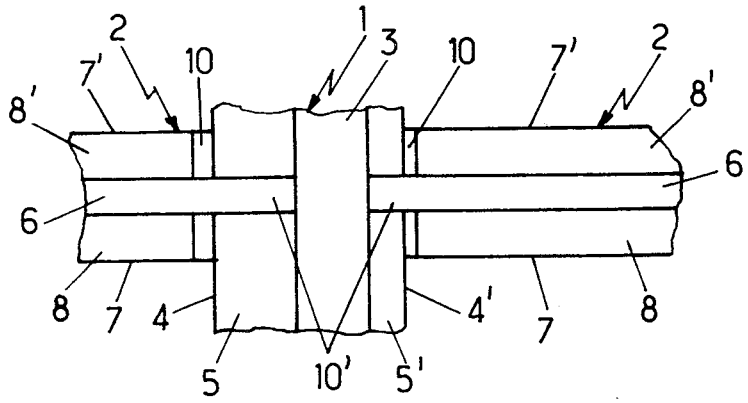
FIG. 3 is a fragmentary top plan view of the frame forming part of the paneling shown in FIG. 1.
Figure 4:
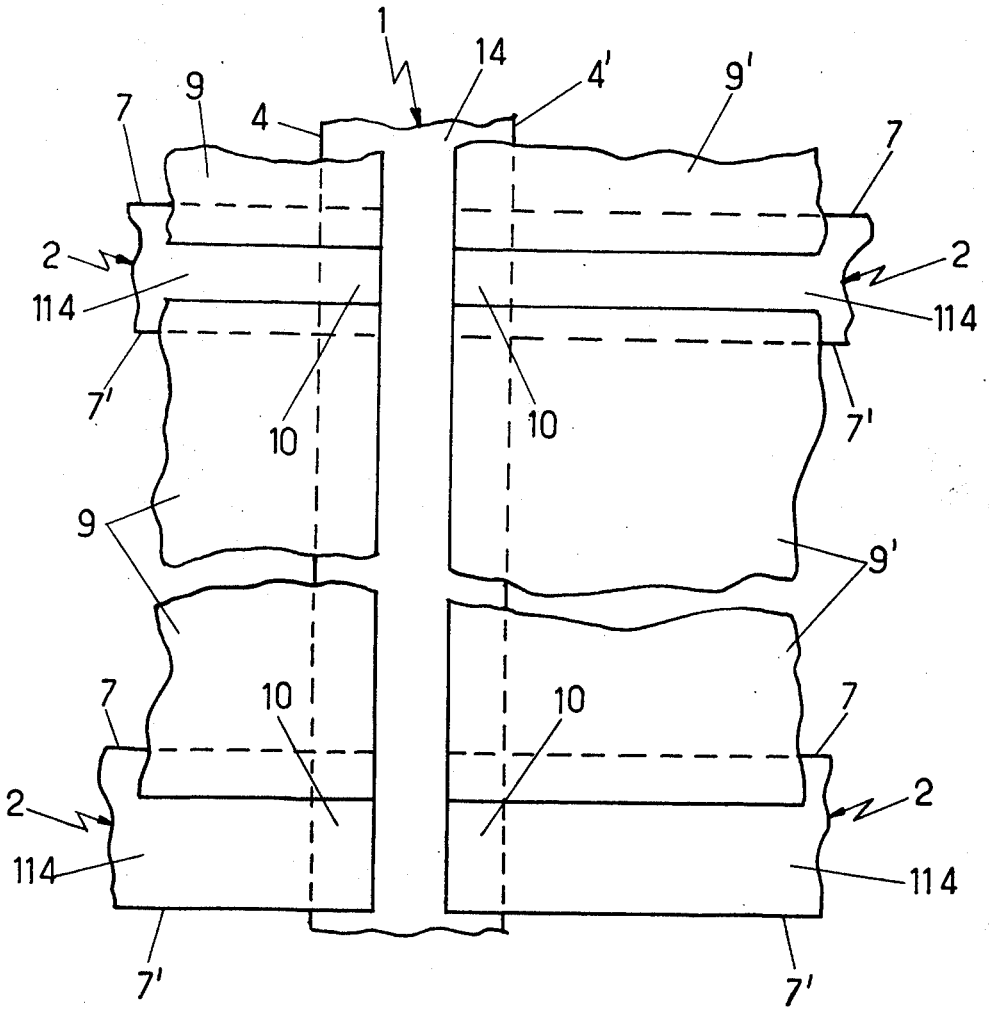
FIG. 4 is a fragmentary bottom plan view of the paneling shown in FIG. 1.

Each molding 2 comprises a relatively thick elongated median portion or web 6 flanked by two elongated projections or ledges 7 and 7'. The molding 2 which is shown in section in FIG. 2 has a symmetrical cross-sectional outline and resembles an inverted T. Those surfaces (numbered 8 and 8') of the ledges 7, 7' which face away from the partially exposed surface 114 of the molding 2 serve to support overlapping portions of rectangular panels 9 and 9' each of which is supported by a pair of parallel moldings 2 (see FIG. 4). The end portions of the moldings 2 are bifurcated, i.e., they are formed with transversely extending recesses or sockets 110 flanked by two projections or prongs 10, 10'. The surface at the underside of the upper prong 10' shown in FIG. 1 overlies and abuts against the inclined surface 5' of the tongue 4' and the upper side of the lower prong 10 shown in FIG. 1 overlies and abuts against a portion of the exposed surface 14 of the brace 1. The left-hand molding 2 of FIG. 3 has been omitted in FIG. 1 in order to show the configuration of that end face of a panel 9 which is adjacent to the brace 1; this left-hand molding 2 is also formed with a recess or socket 110 flanked by two prongs, 10, 10' the latter of which abuts against the inclined surface 5 of the tongue 4.

Those end faces of the panels 9, 9' which are adjacent to a brace 1 are formed with grooves 13 (one shown in FIG. 1) which receive the tongues 4, 4' when the paneling is assembled, i.e., when the panels 9, 9' rest on the ledges 7, 7' of the adjacent pairs of moldings 2. Furthermore, those end faces of the panels 9, 9' which are adjacent to the moldings 2 are bifurcated, i.e., they have longitudinally extending grooves 11, 11' which receive the ledges 7 or 7' of the adjacent moldings. That surface (numbered 12, 12') which bounds the upper side of a groove 11, 11' rests on the upper surface 8 or 8' of the respective ledge 7, 7'.

Those portions of the panels 9, 9' which are located directly below the respective grooves 13 overlie the adjacent portions of the exposed surface 14 of the brace 1, and the upper portions rest on the tongue 4 or 4'.

The paneling is assembled as follows:

The brace or braces 1 are fixed in requisite position and the bifurcated end portions of the moldings 2 are thereupon assembled with the brace or braces in a manner best shown in FIG. 1. Thus, the recess 110 of a molding 2 receives a portion of the tongue 4 or 4'λ whereupon the molding is pushed toward the central portion 3 until the surface at the underside of the upper prong 10' abuts and bears against the inclined surface 5 or 5'. The pushing of a molding 2 toward the central portion 3 is terminated when the entire upper side of the lower prong 10 bears against the adjacent portion of the exposed surface 14 of the brace 1; this insures that the molding is not likely to be twisted even if the molding is subjected to stresses which would tend to move its exposed surface 114 out of exact parallelism with the surface 14. Thus, the just described manner of assembling the moldings 2 with a brace 1 reduces the likelihood of twisting or similar deformation of moldings so that the upper sides of lower prongs 10 continue to remain in face-to-face abutment with the surface 14 of the brace 1. When the moldings 2 are properly assembled with the brace, the panels 9 and 9' are installed in a manner as shown for the lower panels 9, 9' of FIG. 4, i.e., the grooves 11 or 11' of a panel 9 or 9' receive the adjacent ledges 7, 7' of the neighboring moldings 2. Each panel 9 or 9' is supported by two parallel moldings 2 at the respective side of the brace 1. The cutout 13 of a properly mounted panel 9 or 9' receives the adjacent portion of the tongue 4 or 4' of the brace 1. Thus, each properly mounted panel 9 or 9' overlies a portion of the surface 14 between two neighboring moldings 2. The assembly of my improved paneling can be completed within a very short period of time, provided that the component parts 1, 2, 9 and 9' are machined with a certain degree of precision, i.e., provided that the tongues 4, 4' can fit into the recesses 110 and the ledges 7, 7' can fit into the adjacent grooves 11, 11'. There is no need for any special adjustment at the locale of use.

The improved paneling can be used as a decorative covering for the walls or ceiling or a room as well as for many other purposes. Its advantages include an eye-pleasing appearance, the absence of pronounced gaps or cracks between the braces 1 and molding 2 even if the braces and/or moldings exhibit a tendency to warp (e.g., as a result of drying or when the moisture content of their material increases), lower cost for assembly at the locale of use, and rapid dismantling (if and when necessary) without any damage to its components. Moreover, evental deviations of the size and/or shape of one or more components from a predetermined norm are of no consequence, especially as regards the dimensioning of those end portions of the moldings 2 which are to be attached to a brace 1 and/or the configuration of tongues 4, 4'. All component parts can be manufactured and finished in the plant to thus further reduce the period of time which is necessary to assemble the paneling in front of a wall or ceiling. The component parts can be mass-produced and can be stored in a relatively small space because the frame merely consists of two types of components and the panels 9 may be identical with the panels 9'.

Figure 2:
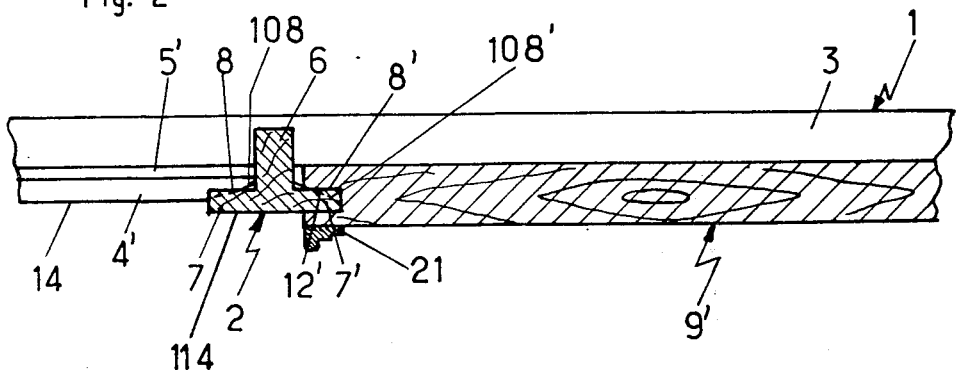
FIG. 2 is a sectional view as seen in the direction of arrows from the line A-A of FIG. 1.

It is also within the purview of the invention to completely conceal the clearances between neighboring panels 9 and 9' (i.e., to completely conceal the central portion of the exposed surface 14 of a brace 1) as well as to completely conceal the clearances between neighboring panels 9 or 9' (i.e., to completely conceal the central portions of the exposed surfaces 114). On the other hand, the paneling may include decorative strips 20 and 21 which are respectively secured to the adjacent portions of neighboring panels 9, 9' (FIG. 1) and to adjacent portions of neighboring panels 9 or 9' (FIG. 2) and which extend along either the exposed portion 14 of brace 1 or the exposed portion 114 of molding 2. Still further, the upper surfaces of the ledges 7 and/or 7' on each molding 2 can be inclined in the same way and for the same purpose as the upper surfaces 5, 5' of the tongues 4, 4'. The inclination of the upper surfaces of the ledges 7, 7' shown in FIG. 2 are indicated by phantom lines 108, 108'.

The component parts of the paneling may be made of a single type of wood or of different types of wood, of synthetic plastic material, partly of wood and partly of synthetic plastic material, of metal and/or other suitable materials.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A decorative and/or protective paneling for walls, ceilings or the like, comprising a skeleton frame including at least one elongated first frame member having two longitudinally extending marginal portions and at least one longitudinally extending tongue which includes one of said marginal portions and tapers in a direction away from the other of said marginal portions, and at least two spaced-apart elongated second frame members having bifurcated end portions into which said tongue extends, each of said end portions having a pair of prongs frictionally engaging said tongue in wedging relationship at the opposite sides thereof; and a panel disposed between and supported by said second frame members.

2. A paneling as defined in claim 1, wherein said first frame member has a first exposed surface extending between said marginal portions and disposed in a first plane, said second frame members having second exposed surfaces disposed in a second plane.

3. A paneling as defined in claim 2, wherein said tongue has a third surface which faces away from and is inclined with respect to said first exposed surface, one prong of each pair of prongs engaging said first exposed surface and the other prong of each pair of prongs engaging said third surface.

4. A paneling as defined in claim 2, wherein each of said second frame members includes a ledge which supports said panel.

5. A paneling as defined in claim 4, wherein said panel has two edge portions provided with grooves receiving said ledges of said second frame members.

6. A paneling as defined in claim 5, wherein each of said ledges has a fourth surface which is inclined with respect to the corresponding second surface so that the thickness of each ledge decreases outwardly, each of said grooves being bounded by two surfaces one of which abuts against the corresponding second surface and the other of which abuts against the corresponding fourth surface.

7. A paneling as defined in claim 2, wherein at least one of said frame members has an asymmetrical cross-sectional outline.

8. A paneling as defined in claim 2, wherein each of said second frame members includes a centrally located elongated web and two ledges disposed at the opposite sides of said web.

9. A paneling as defined in claim 2, wherein said panel has a cutout receiving said tongue intermediate said bifurcated end portions.

10. A paneling as defined in claim 2, wherein said first frame member has a second elongated tongue including said other marginal portion and tapering in a direction away from said one tongue, said frame further including two additional second frame members having bifurcated end portions into which said second tongue extends, each of said last named end portions having a pair of prongs engaging said second tongue at the opposite sides thereof, and further comprising an additional panel disposed between and supported by said additional frame members.

11. A paneling as defined in claim 10, wherein the end portions of said first named second frame members and the end portions of said additional second frame members are spaced apart from each other to expose a portion of said first frame member therebetween, and further comprising an elongated strip supported by said second frame members and extending along said exposed portion of said first frame member.

12. A paneling as defined in claim 1, wherein at least one of said second frame members has two ledges one of which supports said panel, and further comprising a second panel supported by the other ledge of said one second frame member, said panels being spaced apart from each other to expose a portion of said one second frame member, and further comprising an elongated strip supported by said panels and extending along said exposed portion of said one second frame member.

13. A paneling as defined in claim 1, wherein said first frame member, said second frame members and said panel are constituted of wood.

* * * * *